US009951462B2

(12) United States Patent
Scheckelhoff et al.

(10) Patent No.: US 9,951,462 B2
(45) Date of Patent: Apr. 24, 2018

(54) METHOD FOR SUPPLYING HEATED WATER FROM A WATER HEATER APPLIANCE TO A WASHING MACHINE APPLIANCE

(71) Applicant: General Electric Company, Schenectady, NY (US)

(72) Inventors: Ryan James Scheckelhoff, Louisville, KY (US); James Quentin Pollett, Louisville, KY (US); Shaun Michael Ward, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 300 days.

(21) Appl. No.: 14/723,660

(22) Filed: May 28, 2015

(65) Prior Publication Data

US 2016/0348297 A1 Dec. 1, 2016

(51) Int. Cl.

| | |
|---|---|
| ***D06F 39/08*** | (2006.01) |
| ***D06F 39/00*** | (2006.01) |
| ***D06F 33/02*** | (2006.01) |
| *D06F 23/04* | (2006.01) |

(52) U.S. Cl.

CPC ..... *D06F 39/088* (2013.01); *D06F 23/04* (2013.01); *D06F 33/02* (2013.01); *D06F 39/006* (2013.01); *D06F 2204/088* (2013.01)

(58) Field of Classification Search

CPC ..... D06F 39/088

See application file for complete search history.

(56) References Cited

U.S. PATENT DOCUMENTS

| | | | | |
|---|---|---|---|---|
| 5,400,246 | A * | 3/1995 | Wilson | G06F 3/023 340/12.53 |
| 2004/0103484 | A1* | 6/2004 | Kim | D06F 33/02 8/158 |
| 2012/0193985 | A1* | 8/2012 | Kim | D06F 33/02 307/35 |
| 2016/0010878 | A1* | 1/2016 | Lee | F24D 19/1063 700/300 |

FOREIGN PATENT DOCUMENTS

JP 2013132462 A 7/2013

* cited by examiner

*Primary Examiner* — Spencer E Bell

(74) *Attorney, Agent, or Firm* — Dority & Manning, P.A.

(57) ABSTRACT

A method for supplying heated water from a water heater appliance to a washing machine appliance includes initiating a wash cycle of the washing machine appliance, directing heated water from a water heater appliance into the washing machine appliance if a set point temperature of the water heater appliance is equal to or greater than a specific temperature and/or if the water heater appliance contains a volume of heated water required for the wash cycle of the washing machine appliance, and delaying the wash cycle of the washing machine appliance if the set point temperature of the water heater appliance is not equal to or greater than the specific temperature and/or if the water heater appliance does not contain the volume of heated water required for the wash cycle of the washing machine appliance.

9 Claims, 5 Drawing Sheets

METHOD FOR SUPPLYING HEATED WATER FROM A WATER HEATER APPLIANCE TO A WASHING MACHINE APPLIANCE

FIELD OF THE INVENTION

The present subject matter relates generally to water heater appliances and washing machine appliances.

BACKGROUND OF THE INVENTION

Residential, commercial, and industrial locations can include a variety of appliances. For example, water heater appliances, washing machine appliances and the like can be provided at such locations. Conventionally, such appliances were stand alone and incapable of communicating with any other device.

Operating appliances independently has certain drawbacks. For example, certain wash cycles of washing machine appliances, such as sanitization cycles, can require large volumes of heated water at a specific temperature. Generally water heaters are not set up to provide water that is heated to the specific temperature, and heating water within the washing machine appliance to the specific temperature with a heating element of the washing machine appliance can be time consuming and inefficient.

Accordingly, a method for supplying heated water from a water heater appliance to a washing machine appliance would be useful. In particular, a method for supplying heated water from a water heater appliance to a washing machine appliance where the heated water is at a temperature suitable for a sanitization cycle of the washing machine appliance would be useful.

BRIEF DESCRIPTION OF THE INVENTION

The present subject matter provides a method for supplying heated water from a water heater appliance to a washing machine appliance. The method includes initiating a wash cycle of the washing machine appliance, directing heated water from a water heater appliance into the washing machine appliance if a set point temperature of the water heater appliance is equal to or greater than a specific temperature and/or if the water heater appliance contains a volume of heated water required for the wash cycle of the washing machine appliance, and delaying the wash cycle of the washing machine appliance if the set point temperature of the water heater appliance is not equal to or greater than the specific temperature and/or if the water heater appliance does not contain the volume of heated water required for the wash cycle of the washing machine appliance. Additional aspects and advantages of the invention will be set forth in part in the following description, or may be apparent from the description, or may be learned through practice of the invention.

In a first exemplary embodiment, a method for supplying heated water from a water heater appliance to a washing machine appliance is provided. The method includes initiating a wash cycle of the washing machine appliance. The wash cycle of the washing machine appliance requires heated water having a temperature that is equal to or greater than a specific temperature. The method also includes determining a volume of heated water required for the wash cycle of the washing machine appliance and whether a set point temperature of the water heater appliance is equal to or greater than the specific temperature. The method further includes directing heated water from the water heater appliance into the washing machine appliance if the water heater appliance contains the volume of heated water required for the wash cycle of the washing machine appliance and the set point temperature of the water heater appliance is equal to or greater than the specific temperature at the step of determining and delaying the wash cycle of the washing machine appliance if the water heater appliance does not contain the volume of heated water required for the wash cycle of the washing machine appliance or the set point temperature of the water heater appliance is not equal to or greater than the specific temperature at the step of determining.

In a second exemplary embodiment, a method for supplying heated water from a water heater appliance to a washing machine appliance is provided. The method includes initiating a wash cycle of the washing machine appliance. The wash cycle of the washing machine appliance requires water having a temperature that is equal to or greater than a specific temperature. The method also includes determining whether a set point temperature of the water heater appliance is equal to or greater than the specific temperature. The method further includes directing heated water from the water heater appliance into the washing machine appliance if the set point temperature of the water heater appliance is equal to or greater than the specific temperature at the step of determining, delaying the wash cycle of the washing machine appliance if the set point temperature of the water heater appliance is not equal to or greater than the specific temperature at the step of determining, and increasing the set point temperature of the water heater appliance if the set point temperature of the water heater appliance is not equal to or greater than the specific temperature at the step of determining.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
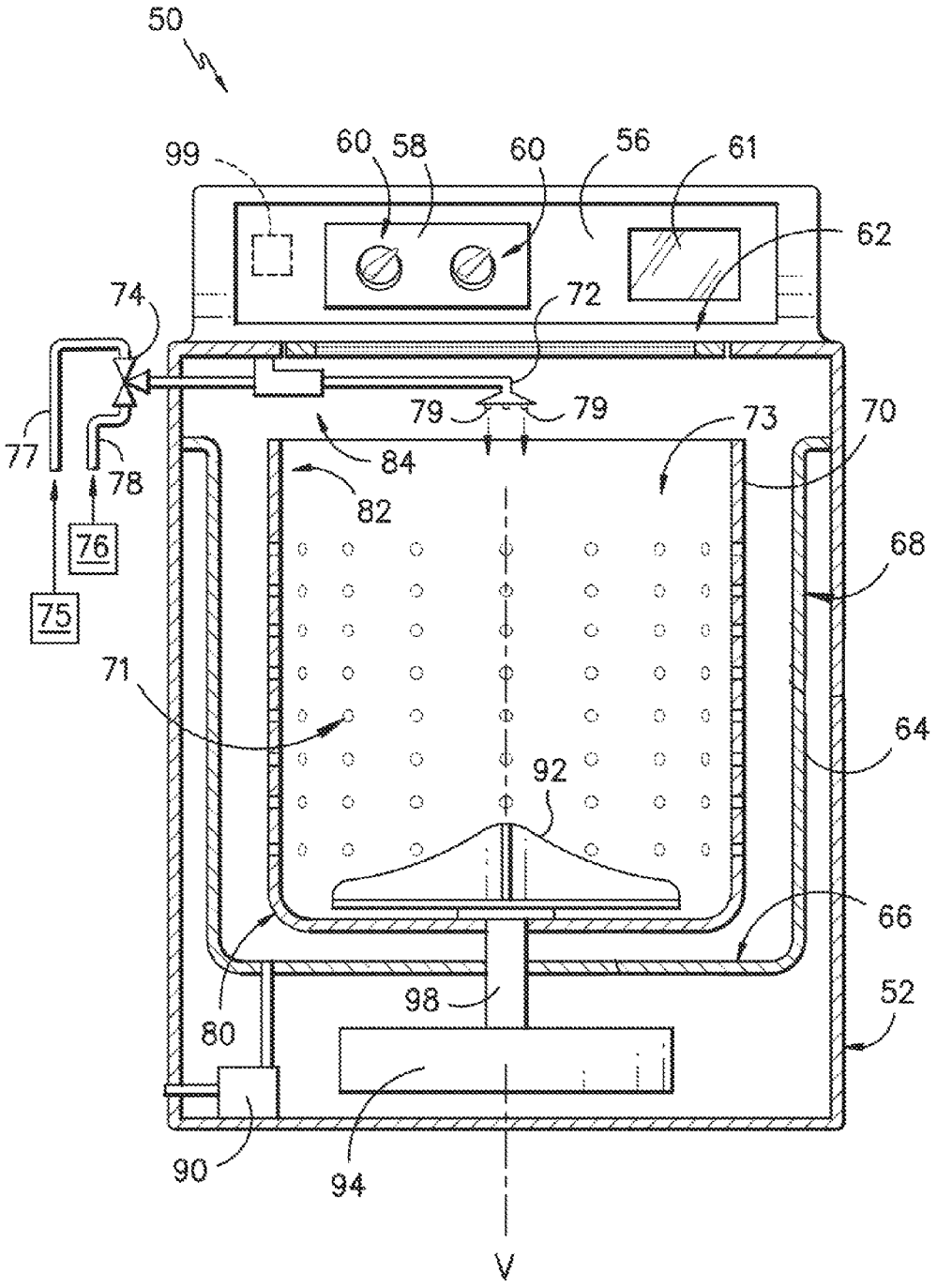
FIG. 1 provides a section view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is front, cross-sectional view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position facilitating access to a wash tub 64 located within cabinet 52 and a closed position forming an enclosure over tub 64.

Tub 64 includes a bottom wall 66 and a sidewall 68. A wash drum or wash basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more water sources 75, 76 in order to direct liquid (e.g. water) into tub 64 and/or onto articles within chamber 73 of basket 70. Nozzle 72 may further include apertures 79 through which water may be sprayed into the tub 64. Apertures 79 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

A main valve 74 regulates the flow of fluid through nozzle 72. For example, valve 74 can selectively adjust to a closed position in order to terminate or obstruct the flow of fluid through nozzle 72. The main valve 74 may be in fluid communication with one or more external water sources, such as a cold water source 75 and a hot water source 76. The cold water source 75 may, for example, be a commercial water supply, while the hot water source 76 may be, for example, a water heater. Such external water sources 75, 76 may supply water to the appliance 50 through the main valve 74. A cold water conduit 77 and a hot water conduit 78 may supply cold and hot water, respectively, from the sources 75, 76 through valve 74. Valve 74 may further be operable to regulate the flow of hot and cold liquid, and thus the temperature of the resulting liquid flowed into tub 64, such as through the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. In some embodiments, nozzle 72 is a separate downstream component from dispenser 84. In other embodiments, nozzle 72 and dispenser 84 may be integral, with a portion of dispenser 84 serving as the nozzle 72. A pump assembly 90 (shown schematically in FIG. 1) is located beneath tub 64 and basket 70 for gravity assisted flow to drain tub 64.

Figure 2:
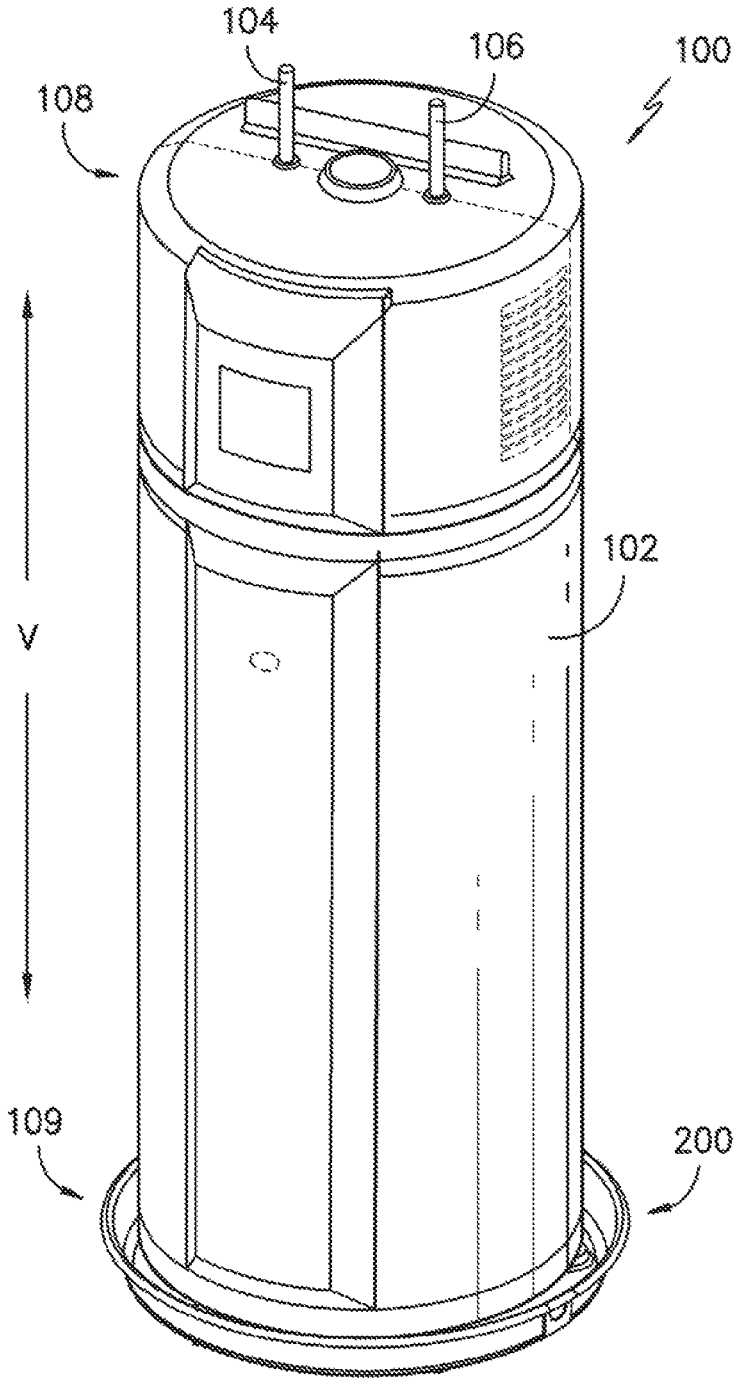
FIG. 2 provides a perspective view of a water heater appliance according to an exemplary embodiment of the present subject matter.

An agitation element 92, shown as an impeller in FIG. 1, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Basket 70 and agitation element 92 are driven by a motor 94, such as a pancake motor. As motor output shaft 98 is rotated, basket 70 and agitation element 92 are operated for rotatable movement within tub 64, e.g., about vertical axis V. Washing machine appliance 50 may also include a brake assembly (not shown) selectively applied or released for respectively maintaining basket 70 in a stationary position within tub 64 or for allowing basket 70 to spin within tub 64.

Operation of washing machine appliance 50 is controlled by a processing device or controller 99 that is operatively coupled to the input selectors 60 located on washing machine backsplash 56 for user manipulation to select washing machine cycles and features. Controller 99 may further be operatively coupled to various other components of washing machine appliance 50, such as main valve 74, motor 94, etc. In response to user manipulation of the input selectors 60, controller 99 may operate the various components of washing machine appliance 50 to execute selected machine cycles and features.

Controller 99 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 99 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 99 via one or more signal lines or shared communication busses.

In an illustrative embodiment, laundry items are loaded into chamber 73 of basket 70, and washing operation is initiated through operator manipulation of control input selectors 60. Tub 64 is filled with water and mixed with detergent to form a liquid or wash fluid. Main valve 74 can be opened to initiate a flow of water into tub 64 via nozzle 72, and tub 64 can be filled to the appropriate level for the amount of articles being washed. Once tub 64 is properly filled with wash fluid, the contents of the basket 70 are agitated with agitation element 92 for cleaning of articles in basket 70. More specifically, agitation element 92 is moved back and forth in an oscillatory motion.

After the agitation phase of the wash cycle is completed, tub 64 is drained. Laundry articles can then be rinsed by again adding fluid to tub 64, depending on the particulars of the cleaning cycle selected by a user, agitation element 92 may again provide agitation within basket 70. One or more spin cycles may also be used. In particular, a spin cycle may be applied after the wash cycle and/or after the rinse cycle in order to wring wash fluid from the articles being washed. During a spin cycle, basket 70 is rotated at relatively high speeds.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
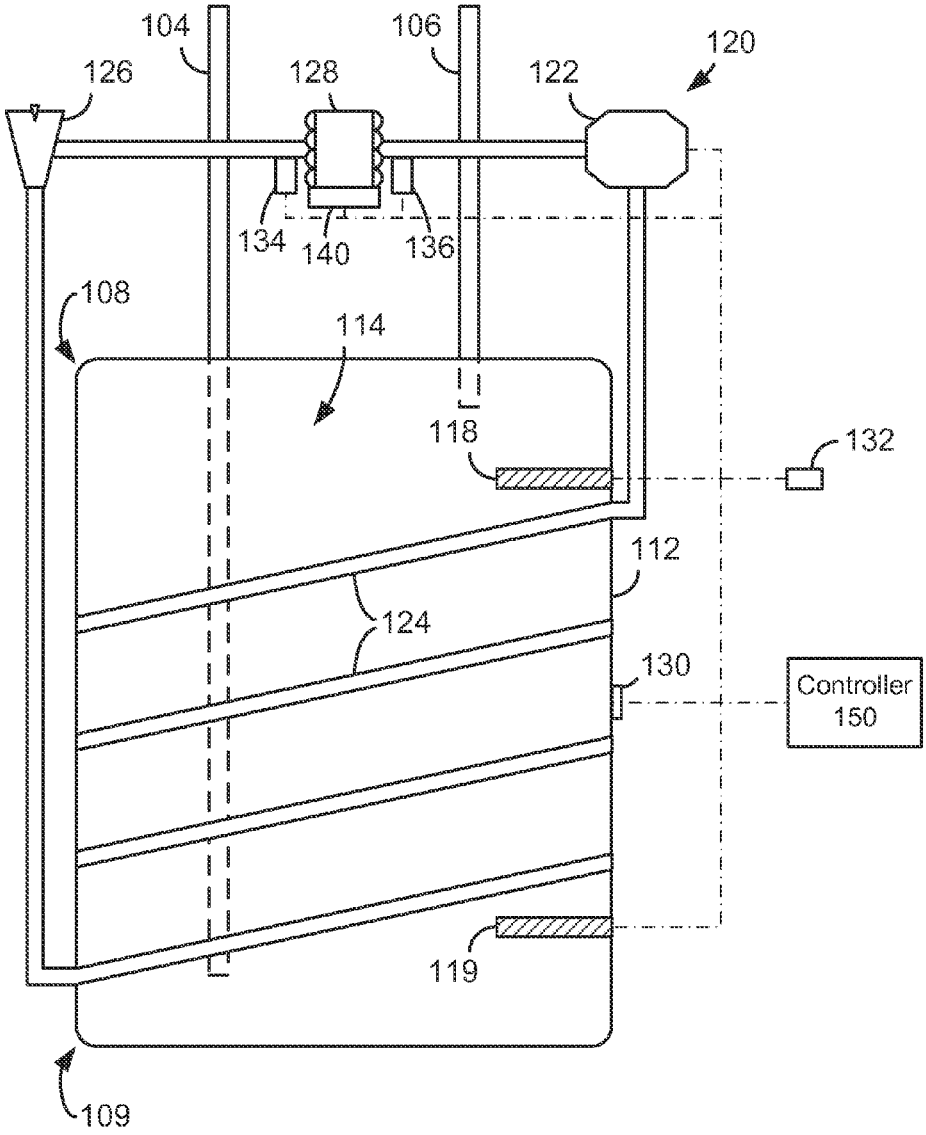
FIG. 3 provides a schematic view of certain components of the exemplary water heater appliance of FIG. 2.

FIG. 2 provides a perspective view of a water heater appliance 100 according to an exemplary embodiment of the present subject matter. FIG. 3 provides a schematic view of certain components of water heater appliance 100. As may be seen in FIGS. 2 and 3, water heater appliance 100 includes a casing 102 and a tank 112 mounted within casing 102. Tank 112 defines an interior volume 114 for heating water therein.

Water heater appliance 100 also includes a cold water conduit 104 and a hot water conduit 106 that are both in fluid communication with tank 112 within casing 102. As an example, cold water from a water source, e.g., a municipal water supply or a well, enters water heater appliance 100 through cold water conduit 104. From cold water conduit 104, such cold water enters interior volume 114 of tank 112 wherein the water is heated to generate heated water. Such heated water exits water heater appliance 100 at hot water conduit 106 and, e.g., is supplied to a bath, shower, sink, washing machine appliance (e.g., washing machine appliance 50), or any other suitable feature.

As may be seen in FIG. 2, water heater appliance 100 extends between a top portion 108 and a bottom portion 109 along a vertical direction V. Thus, water heater appliance 100 is generally vertically oriented. Water heater appliance 100 can be leveled, e.g., such that casing 102 is plumb in the vertical direction V, in order to facilitate proper operation of water heater appliance 100.

A drain pan 110 is positioned at bottom portion 109 of water heater appliance 100 such that water heater appliance 100 sits on drain pan 110. Drain pan 110 sits beneath water heater appliance 100 along the vertical direction V, e.g., to collect water that leaks from water heater appliance 100 or water that condenses on an evaporator 128 of water heater appliance 100. It should be understood that water heater appliance 100 is provided by way of example only and that the present subject matter may be used with any suitable water heater appliance.

Turning now to FIG. 3, water heater appliance 100 includes an upper heating element 118, a lower heating element 119 and a sealed system 120 for heating water within interior volume 114 of tank 112. Thus, water heater appliance 100 is commonly referred to as a "heat pump water heater appliance." Upper and lower heating elements 118 and 119 can be any suitable heating elements. For example, upper heating element 118 and/or lower heating element 119 may be an electric resistance element, a microwave element, an induction element, or any other suitable heating element or combination thereof. Lower heating element 119 may also be a gas burner.

Sealed system 120 includes a compressor 122, a condenser 124, a throttling device 126 and an evaporator 128. Condenser 124 is thermally coupled or assembled in a heat exchange relationship with tank 112 in order to heat water within interior volume 114 of tank 112 during operation of sealed system 120. In particular, condenser 124 may be a conduit coiled around and mounted to tank 112. During operation of sealed system 120, refrigerant exits evaporator 128 as a fluid in the form of a superheated vapor and/or high quality vapor mixture. Upon exiting evaporator 128, the refrigerant enters compressor 122 wherein the pressure and temperature of the refrigerant are increased such that the refrigerant becomes a superheated vapor. The superheated vapor from compressor 122 enters condenser 124 wherein it transfers energy to the water within tank 112 and condenses into a saturated liquid and/or high quality liquid vapor mixture. This high quality/saturated liquid vapor mixture exits condenser 124 and travels through throttling device 126 that is configured for regulating a flow rate of refrigerant therethrough. Upon exiting throttling device 126, the pressure and temperature of the refrigerant drop at which time the refrigerant enters evaporator 128 and the cycle repeats itself. In certain exemplary embodiments, throttling device 126 may be an electronic expansion valve (EEV).

A fan or air handler 140 may assist with heat transfer between air about water heater appliance 100, e.g., within casing 102, and refrigerant within evaporator 128. Air handler 140 may be positioned within casing 102 on or adjacent evaporator 128. Thus, when activated, air handler 140 may direct a flow of air towards or across evaporator 128, and the flow of air from air handler 140 may assist with heating refrigerant within evaporator 128. Air handler 140 may be any suitable type of air handler, such as an axial or centrifugal fan.

Water heater appliance 100 also includes a tank temperature sensor 130. Tank temperature sensor 130 is configured for measuring a temperature of water within interior volume 114 of tank 112. Tank temperature sensor 130 can be positioned at any suitable location within or on water heater appliance 100. For example, tank temperature sensor 130 may be positioned within interior volume 114 of tank 112 or may be mounted to tank 112 outside of interior volume 114 of tank 112. When mounted to tank 112 outside of interior volume 114 of tank 112, tank temperature sensor 130 can be configured for indirectly measuring the temperature of water within interior volume 114 of tank 112. For example, tank temperature sensor 130 can measure the temperature of tank 112 and correlate the temperature of tank 112 to the temperature of water within interior volume 114 of tank 112. Tank temperature sensor 130 may also be positioned at or adjacent top portion 108 of water heater appliance 100, e.g., at or adjacent an inlet of hot water conduit 106.

Tank temperature sensor 130 can be any suitable temperature sensor. For example, tank temperature sensor 130 may be a thermocouple or a thermistor. As may be seen in FIG. 3, tank temperature sensor 130 may be the only temperature sensor positioned at or on tank 112 that is configured for measuring the temperature of water within interior volume 114 of tank 112 in certain exemplary embodiments. In alternative exemplary embodiments, additional temperature sensors may be positioned at or on tank 112 to assist tank temperature sensor 130 with measuring the temperature of water within interior volume 114 of tank 112, e.g., at other locations within interior volume 114 of tank 112.

Water heater appliance 100 also includes an ambient temperature sensor 132, an evaporator inlet temperature sensor 134 and an evaporator outlet temperature sensor 136. Ambient temperature sensor 132 is configured for measuring a temperature of air about water heater appliance 100. Ambient temperature sensor 132 can be positioned at any suitable location within or on water heater appliance 100. For example, ambient temperature sensor 132 may be mounted to casing 102, e.g., at or adjacent top portion 108 of water heater appliance 100. Ambient temperature sensor 132 can be any suitable temperature sensor. For example, ambient temperature sensor 132 may be a thermocouple or a thermistor.

Evaporator inlet temperature sensor 134 is configured for measuring a temperature of refrigerant at or adjacent inlet of evaporator 128. Thus, evaporator inlet temperature sensor 134 may be positioned at or adjacent inlet of evaporator 128, as shown in FIG. 3. For example, evaporator inlet temperature sensor 134 may be mounted to tubing that directs refrigerant into evaporator 128, e.g., at or adjacent inlet of evaporator 128. When mounted to tubing, evaporator inlet temperature sensor 134 can be configured for indirectly measuring the temperature of refrigerant at inlet of evaporator 128. For example, evaporator inlet temperature sensor 134 can measure the temperature of the tubing and correlate the temperature of the tubing to the temperature of refrigerant at inlet of evaporator 128. Evaporator inlet temperature sensor 134 can be any suitable temperature sensor. For example, evaporator inlet temperature sensor 134 may be a thermocouple or a thermistor.

Evaporator outlet temperature sensor 136 is configured for measuring a temperature of refrigerant at or adjacent outlet of evaporator 128. Thus, evaporator outlet temperature sensor 136 may be positioned at or adjacent outlet of evaporator 128, as shown in FIG. 3. For example, evaporator outlet temperature sensor 136 may be mounted to tubing that directs refrigerant out of evaporator 128, e.g., at or adjacent outlet of evaporator 128. When mounted to tubing, evaporator outlet temperature sensor 136 can be configured for indirectly measuring the temperature of refrigerant at outlet of evaporator 128. For example, evaporator outlet temperature sensor 136 can measure the temperature of the tubing and correlate the temperature of the tubing to the temperature of refrigerant at outlet of evaporator 128. Evaporator outlet temperature sensor 136 can be any suitable temperature sensor. For example, evaporator outlet temperature sensor 136 may be a thermocouple or a thermistor.

Water heater appliance 100 further includes a controller 150 that is configured for regulating operation of water heater appliance 100. Controller 150 is in, e.g., operative, communication with upper heating element 118, lower heating element 119, compressor 122, tank temperature sensor 130, ambient temperature sensor 132, evaporator inlet temperature sensor 134, evaporator outlet temperature sensor 136, and air handler 140. Thus, controller 150 may selectively activate upper and lower heating elements 118 and 119 and/or compressor 122 in order to heat water within interior volume 114 of tank 112, e.g., in response to signals from tank temperature sensor 130, ambient temperature sensor 132, evaporator inlet temperature sensor 134 and/or evaporator outlet temperature sensor 136.

Controller 150 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may operate upper heating element 118, lower heating element 119 and/or compressor 122 in order to heat water within interior volume 114 of tank 112. As an example, a user may select or establish a set temperature, $t_s$, for water within interior volume 114 of tank 112, or the set temperature $t_s$ for water within interior volume 114 of tank 112 may be a default value. Based upon the set temperature $t_s$ for water within interior volume 114 of tank 112, controller 150 may selectively activate upper heating element 118, lower heating element 119 and/or compressor 122 in order to heat water within interior volume 114 of tank 112 to the set temperature $t_s$ for water within interior volume 114 of tank 112. The set temperature $t_s$ for water within interior volume 114 of tank 112 may be any suitable temperature. For example, the set temperature $t_s$ for water within interior volume 114 of tank 112 may be between about one hundred degrees Fahrenheit and about one hundred and eighty-degrees Fahrenheit. As used herein with regards to temperature approximations, the term "about" means within ten degrees of the stated temperature.

While described in the context of a specific embodiment of water heater appliance 100, using the teachings disclosed herein it will be understood that water heater appliance 100 is provided by way of example only. Other water heater appliances having different configurations (such as gas water heaters, standard electric water heaters, etc.), different appearances, and/or different features may also be utilized with the present subject matter as well.

Figure 4:
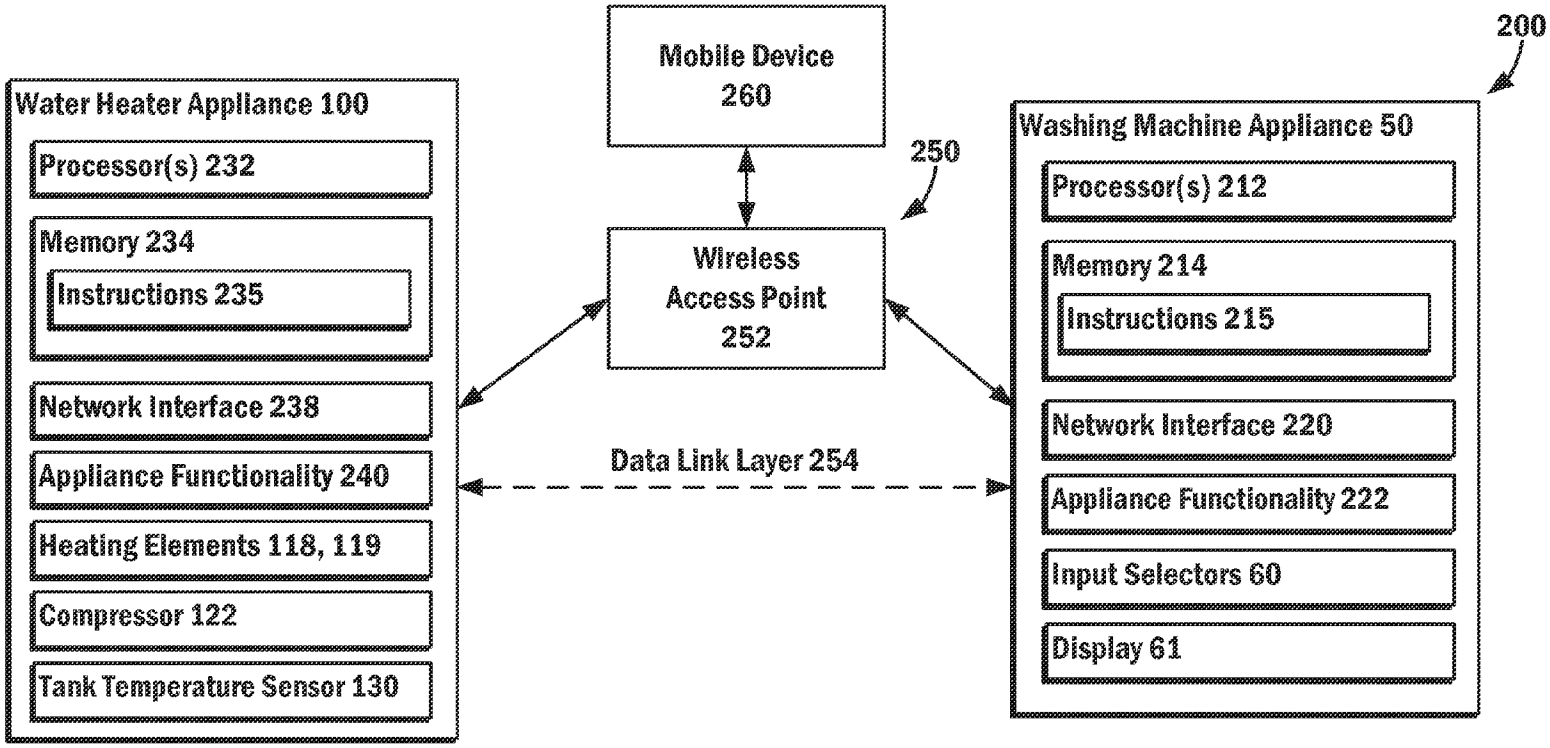
FIG. 4 provides a schematic view a system for connecting the exemplary water heater appliance of FIG. 2 with the exemplary washing machine appliance of FIG. 1 according to an exemplary embodiment of the present subject matter.

FIG. 4 provides a schematic view of a system 200 for operating a washing machine appliance 50 and/or water heater appliance 100 according to an exemplary embodiment of the present subject matter. System 200 includes stations, such as washing machine appliance 50 and water heater appliance 100. Washing machine appliance 50 and water heater appliance 100 are in communication with one another, e.g., via a network 250. As discussed in greater detail below, system 200 includes features for assisting with regulating operation of washing machine appliance 50 and/or water heater appliance 100 in order to supply washing machine appliance 50 with suitable heated water from water heater appliance 100.

Washing machine appliance 50 includes one or more processors 212, a memory 214, and a network interface 220, and provides appliance functionality 222, such as a wash cycle, spin cycle, etc. Network interface 220 of washing machine appliance 50 can include any suitable components for interfacing with one more networks, such as network 250. For example, network interface 220 of washing machine appliance 50 may include transmitters, receivers, ports, controllers, antennas, or other suitable components.

The processor(s) 212 of washing machine appliance 50 can be any suitable processing device, such as a microprocessor, microcontroller, integrated circuit, or other suitable processing device. The memory 214 of washing machine appliance 50 can include any suitable computing system or media, including, but not limited to, non-transitory computer-readable media, RAM, ROM, hard drives, flash drives, or other memory devices. The memory 214 of washing machine appliance 50 can store information accessible by processor(s) 212 of washing machine appliance 50, including instructions 215 that can be executed by processor(s) 212 of washing machine appliance 50 to control various components of washing machine appliance 50 to provide appliance functionality 222.

Water heater appliance 100 includes one or more processors 232 and a memory 234 and provides appliance functionality 240, such as a heat pump heating cycle, a backup heating cycle, a hybrid heating cycle, etc. The processor(s) 232 of water heater appliance 100 can be any suitable processing device, such as a microprocessor, microcontroller, integrated circuit, or other suitable processing device. The memory 234 of water heater appliance 100 can include any suitable computing system or media, including, but not limited to, non-transitory computer-readable media, RAM, ROM, hard drives, flash drives, or other memory devices. The memory 234 of water heater appliance 100 can store information accessible by processor(s) 232 of water heater appliance 100, including instructions 235 that can be executed by processor(s) 232 of water heater appliance 100 to control various components of water heater appliance 100.

Network interface 238 of water heater appliance 100 can include any suitable components for interfacing with one more networks, such as network 250. For example, network interface 238 of water heater appliance 100 may include transmitters, receivers, ports, controllers, antennas, or other suitable components.

As discussed above, washing machine appliance 50 and water heater appliance 100 are in communication with one another via network 250. The network 250 can be any type of communications network, such as a local area network (e.g. intranet), wide area network (e.g. Internet), or some combination thereof. The network 250 includes a wireless access point 252 and/or a data link layer 254 for placing washing machine appliance 50 and water heater appliance 100 in communication with one another. Thus, washing machine appliance 50 and water heater appliance 100 can be in indirect communication with one another via wireless access point 252. Further, washing machine appliance 50 and water heater appliance 100 can be in direct communication with one another via data link layer 254. In general, communication between washing machine appliance 50 and water heater appliance 100 can be carried via associated network interfaces using any type of wireless connection, using a variety of communication protocols (e.g. TCP/IP, HTTP), encodings or formats (e.g. HTML, XML), and/or protection schemes (e.g. VPN, secure HTTP, SSL). In particular, the network 250 may be a wireless local area network (WLAN) configured to conform to IEEE 802.11.

System 200 also includes a mobile device 260. Mobile device 260 may be in communication with washing machine appliance 50 and/or water heater appliance 100 via network 250. Thus, e.g., a user of mobile device 260 may regulate operation of washing machine appliance 50 and/or water heater appliance 100 by inputting commands for operation of washing machine appliance 50 and/or water heater appliance 100 at mobile device 260. Mobile device 260 can be any suitable type of mobile computing device, such as a general purpose computer, special purpose computer, laptop, integrated circuit, smartphone, tablet, wearable computing device, or other suitable mobile computing device.

Mobile device 260 may include a display for presenting information to a user of mobile device 260. The display may include, for example, a liquid crystal display panel (LCD), a plasma display panel (PDP), or any other suitable mechanism for displaying an image. Mobile device 260 may further include a user interface configured for permitting a user of mobile device 260 to manage operation of mobile device 260. The user interface may include any suitable type of interface, such as a touch screen, a keypad, knobs, sliders, buttons, speech recognition, etc., that permits a user to input control commands for mobile device 260.

Figure 5:
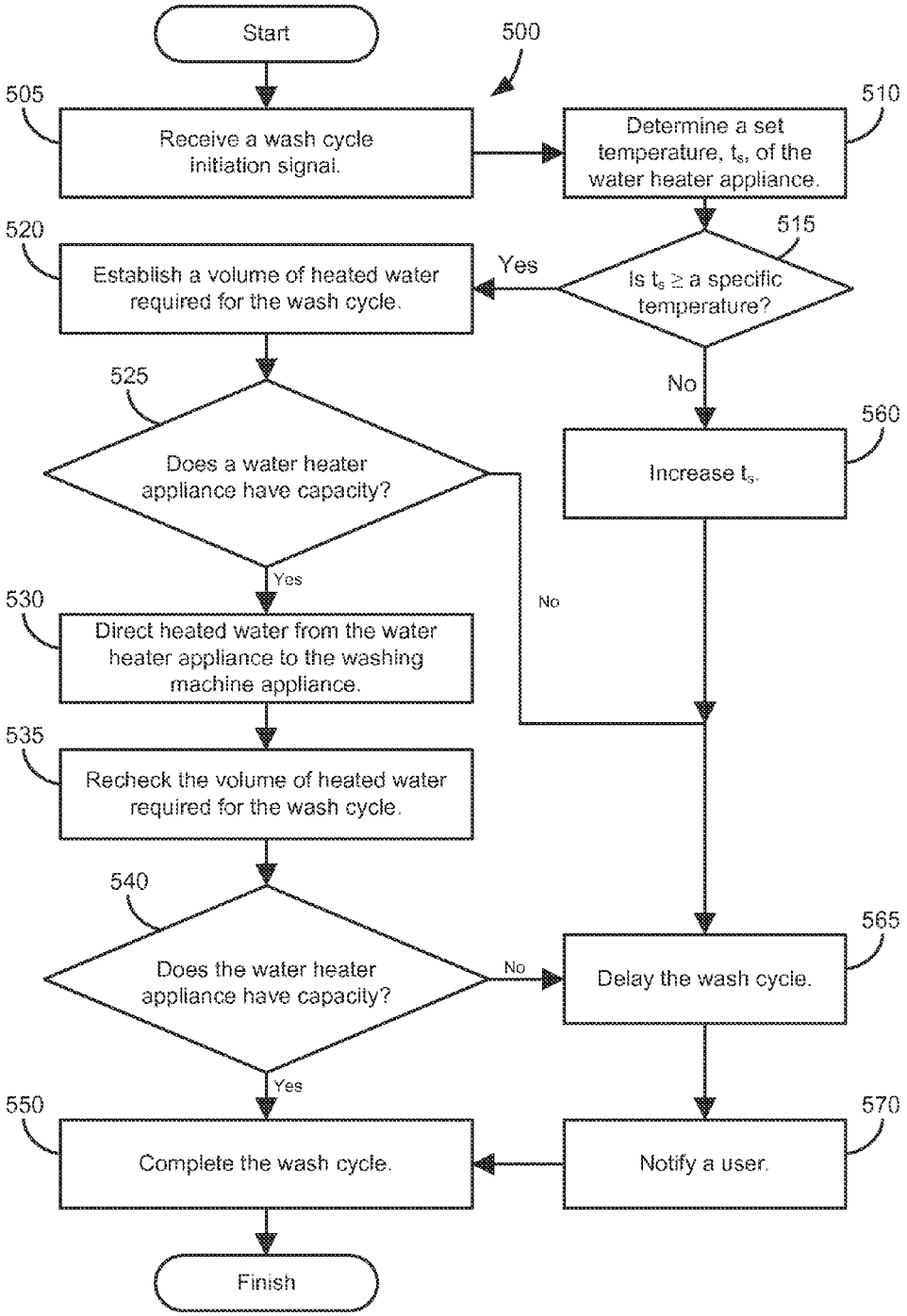
FIG. 5 illustrates a method for supply heated water to a washing machine appliance according to an exemplary embodiment of the present subject matter.

FIG. 5 illustrates a method 500 for supply heated water to a washing machine appliance according to an exemplary embodiment of the present subject matter. Method 500 may be utilized with any suitable water heater appliance and washing machine appliance. For example, method 500 may be utilized with water heater appliance 100 (FIG. 3) and washing machine appliance 50 (FIG. 1) to regulate supply of heated water from water heater appliance 100 to washing machine appliance 50. Controller 99 of washing machine appliance 50, controller 150 of water heater appliance 100 and/or mobile device 260 may be programmed or configured to implement method 500. Method 500 may assist with providing heated water from water heater appliance 100 to washing machine appliance 50 such that the heated water is suitable for a particular cycle of the washing machine appliance 50, as discussed in greater detail below.

At step 505, a wash cycle initiation signal is received, e.g., at washing machine appliance 50. As an example, a user of washing machine appliance 50 may utilize input selectors 60 on control panel 58 of washing machine appliance 50 to generate the wash cycle initiation signal. As another example, the user of washing machine appliance 50 may utilize mobile device 260 (FIG. 4) to generate the wash cycle initiation signal, and the wash cycle initiation signal may be delivered to washing machine appliance 50 via network 250.

The wash cycle of washing machine appliance 50 may be any suitable wash cycle. For example, the wash cycle of washing machine appliance 50 may be a sanitization wash cycle that assists with reducing microbial activity on a load within washing machine appliance 50 or an allergen cycle that assists with reducing allergen concentrations on the load within washing machine appliance 50. The wash cycle of washing machine appliance 50 may require heated water having a temperature that is equal to or greater than a specific temperature, $t_c$, e.g., in order to provide effective or suitable cleaning or sanitization of articles within washing machine appliance 50. The specific temperature $t_c$ may be any suitable temperature. For example, the specific temperature $t_c$ may be at least one hundred and thirty degrees Fahrenheit, at least one hundred and fifty degrees Fahrenheit, at least one hundred and seventy degrees Fahrenheit, etc. The specific temperature may also be selected such that the wash cycle of washing machine appliance 50 complies with NSF Protocol P172 and/or NSF Protocol P351.

At step 510, the set temperature $t_s$ of water heater appliance 100 is determined. For example, the controller 150 of water heater appliance 100 or mobile device 260 may access the memory 214 of water heater appliance 100 to determine the set temperature $t_s$ of water heater appliance 100 at step 510 if the set temperature ti of water heater appliance 100 is stored within memory 214 of water heater appliance 100. As another example, water heater appliance 100 may broadcast the set temperature $t_s$ of water heater appliance 100 at step 510 such that other components of system 200 receive the set temperature $t_s$ of water heater appliance 100 at step 510.

At step 515, the set temperature $t_s$ of water heater appliance 100 is compared to the specific temperature $t_c$. For example, the controller 150 of water heater appliance 100 or mobile device 260 may determine whether the set temperature $t_s$ of water heater appliance 100 is greater than or equal to the specific temperature $t_c$. When the set temperature $t_s$ of water heater appliance 100 is greater than or equal to the specific temperature $t_c$, water heater appliance 100 may be able to quickly supply heated water to washing machine appliance 50 at or above the specific temperature $t_c$. Conversely, water heater appliance 100 may not be able to quickly supply heated water to washing machine appliance 50 at or above the specific temperature $t_c$, when the set temperature $t_s$ of water heater appliance 100 is less than the specific temperature $t_c$.

At step 515, the set temperature $t_s$ of water heater appliance 100 is compared to the specific temperature $t_c$. For example, the controller 150 of water heater appliance 100 or mobile device 260 may determine whether the set temperature $t_s$ of water heater appliance 100 is greater than or equal to the specific temperature $t_c$. When the set temperature $t_s$ of water heater appliance 100 is greater than or equal to the specific temperature $t_c$, water heater appliance 100 may be able to quickly supply heated water to washing machine appliance 50 at or above the specific temperature $t_c$. Conversely, water heater appliance 100 may not be able to quickly supply heated water to washing machine appliance 50 at or above the specific temperature $t_c$ when the set temperature $t_s$ of water heater appliance 100 is greater than or equal to the specific temperature $t_c$.

If the set temperature $t_s$ of water heater appliance 100 is greater than or equal to the specific temperature $t_c$ at step 515, a volume of heated water required for the wash cycle of washing machine appliance 50 is determined at step 520. As an example, controller 99 of washing machine appliance 50 may determine the volume of heated water required for the wash cycle of washing machine appliance 50 at step 520. Any suitable method or mechanism may be used to estimate or determine the volume of heated water required for the wash cycle of washing machine appliance 50 at step 520. For example, a user may estimate the load size of articles within washing machine appliance 50 or a default value for the load size of articles within washing machine appliance 50 may be utilized, and the load size may be used to calculate or determine the volume of heated water required for the wash cycle of washing machine appliance 50. For example, each load size may correspond to a respective volume of heated water required for the wash cycle of washing machine appliance 50, as will be understood by those skilled in the art.

At step 525, a capacity of water heater appliance 100 (e.g., a volume of heated water within tank 112 of water heater appliance 100) is determined and evaluated with respect to the volume of heated water required for the wash cycle of washing machine appliance 50. In particular, if sufficient heated water is contained within water heater appliance 100 to satisfy the requirements of the washing cycle of washing machine appliance 50, method 500 continues to step 530. Conversely, method 500 continues to step 565 if sufficient heated water is not contained within water heater appliance 100 to satisfy the requirements of the washing cycle of washing machine appliance 50.

At step 530, heated water from water heater appliance 100 is directed into washing machine appliance 50. As an example, controller 99 of washing machine appliance 50 may open main valve 74 in order to allow heated water from water heater appliance 100 to flow into washing machine appliance 50 via hot water conduit 78. Thus, if water heater appliance 100 contains the volume of heated water required for the wash cycle of washing machine appliance 50 at step 525 and the set point temperature of water heater appliance 100 is equal to or greater than the specific temperature $t_c$ at step 510, then heated water from water heater appliance 100 is directed into washing machine appliance 50 at step 530.

At step 535, the volume of heated water required for the wash cycle of washing machine appliance 50 is rechecked. For example, with heated water from water heater appliance 100 flowing into washing machine appliance 50, a more accurate value for the volume of heated water required for the wash cycle of washing machine appliance 50 may be determined. Any suitable method or mechanism may be used to determine the volume of heated water required for the wash cycle of washing machine appliance 50 at step 535. For example, the method described in U.S. Patent Publication No. 2015/0000047 of Roberto Obregon entitled "Washing Machine Appliance and Method for Operating the Same," which is hereby incorporated by reference in its entirety for all purposes, may be used to assist with determining the volume of heated water required for the wash cycle of washing machine appliance 50 at step 535.

At step 540, the capacity of water heater appliance 100 (e.g., volume of heated water within tank 112 of water heater appliance 100) is compared and evaluated with respect to the rechecked volume of heated water required for the wash cycle of washing machine appliance 50. If sufficient heated water is contained within water heater appliance 100 to satisfy the requirements of the washing cycle of washing machine appliance 50, method 500 continues to step 550. Conversely, method 500 continues to step 565 if sufficient heated water is not contained within water heater appliance 100 to satisfy the requirements of the washing cycle of washing machine appliance 50.

At step 550, the wash cycle of washing machine appliance 50 is completed. As discussed above, steps 510-540 of method 500 may assist with ensuring that sufficient heated water is contained within water heater appliance 100 to satisfy the requirements of the washing cycle of washing machine appliance 50. Thus, prior to starting and/or continuing the washing cycle of washing machine appliance 50, method 500 may test whether water heater appliance 100 is capable or ready to provide sufficient heated water to satisfy the requirements of the washing cycle of washing machine appliance 50.

Returning to step 515, if the set temperature $t_s$ of water heater appliance 100 is not greater than or equal to the specific temperature $t_c$, method 500 continues to step 560. At step 560, the set temperature $t_s$ of water heater appliance 100 is increased. As an example, a user of water heater appliance 100 may increase the set temperature $t_s$ of water heater appliance 100 at step 515, e.g., via mobile device 260 or control inputs of water heater device 100. Thus, the set temperature $t_s$ of water heater appliance 100 may be increased at step 560 in order to provide suitably heated water from water heater appliance 100 to washing machine appliance 50 for the wash cycle of washing machine appliance 50. In alternative exemplary embodiments, method 500 need not include step 560, and method 500 may instead continue to step 550 if the set temperature $t_s$ of water heater appliance 100 is not greater than or equal to the specific temperature $t_c$ at step 515.

At step 565, the wash cycle of washing machine appliance 50 is delayed. The wash cycle of washing machine appliance 50 is delayed at step 565 if water heater appliance 100 does not contain the volume of heated water required for the wash cycle of washing machine appliance 50 at step 525 or the set point temperature of water heater appliance 100 is not equal to or greater than the specific temperature $t_c$ at step 510. Thus, the wash cycle of washing machine appliance 50 may be delayed in order to provide time for the water heater appliance 50 to heat water within water heater appliance 100 (e.g., to the increased set temperature $t_s$ of water heater appliance 100 from step 560) and generate sufficient heated water to satisfy the requirements of the washing cycle of washing machine appliance 50. Heated water from water heater appliance 100 may not be directed into washing machine appliance 50 during step 565.

The wash cycle of washing machine appliance 50 may be delayed for any suitable period of time at step 565. For example, an elapsed time since a start of step 565 may be determined, and step 565 may be terminated if the elapsed time exceeds a maximum delay. The maximum delay may be any suitable time period. For example, the maximum delay may be is greater than fifteen minutes and less than three hours, greater than thirty minutes and less than two hours, greater than thirty minutes and less than one hour, etc. In such a manner, the delay provided at step 565 may be limited to the maximum delay, and method 500 may continue to step 550 if step 565 meets or exceeds the maximum delay.

At step 570, a user of washing machine appliance 50 is notified that the wash cycle the washing machine appliance 50 is delayed at step 565. Any suitable method or mechanism may be used to notify the user at step 570. For example, a text message, electronic mail message or an instant message may be sent to the user of washing machine appliance 50, and the user may receive the message at mobile device 260. As another example, a message may be presented on display 61 of washing machine appliance 50 at step 565.

Method 500 may also include determining a heat loss of water within washing machine appliance 50, e.g., due to step 565. To account or mitigate such heat loss, method 500 may include adding additional heated water from water heater appliance 100 into washing machine appliance 50 or increasing a temperature of water delivered from water heater appliance 100 into washing machine appliance 50, e.g., during step 550. As an example, if there was a delay of thirty minutes at step 565 due to water heater appliance 100 not containing sufficient heated water to satisfy the requirements of the washing cycle of washing machine appliance 50 at step 540, heated water within washing machine appliance 50 during step 565 will lose heat during the thirty minute delay. Method 500 may include direct more heated water from water heater appliance 100 into washing machine appliance 50 or increase a temperature of water delivered from water heater appliance 100 into washing machine appliance 50 during step 550 in order to account for the lost heat. In particular, the volume of heated water delivered to washing machine appliance 50 prior to step 550 may be determined and a temperature sensor on tub 64 may assist with calculating the heat loss during step 565 and also the additional heat needed to reach the specific temperature $t_c$ after step 565, e.g., at step 550.

Network 250 may also permit communication with a cloud service provider, such as a suitable website. The cloud service provider may be configured for implementing at least a portion of method 500. Thus, it should be understood that method 500 or portions of method 500 may be implemented as a cloud-based service.

It should be understood that method 500 may be modified for other appliances. For example, method 500 may be used to supplying heated water from a water heater appliance to any other suitable appliance in alternative exemplary embodiments. For example, method 500 may be used with dishwasher appliances, coffee maker appliances, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for supplying heated water from a water heater appliance to a washing machine appliance, comprising:

operating the water heater appliance such that the water heater appliance heats water to a set point temperature of the water heater appliance;

initiating a wash cycle of the washing machine appliance during said step of operating, the wash cycle of the washing machine appliance requiring heated water having a temperature that is equal to or greater than a specific temperature, the specific temperature being greater than one hundred and thirty degrees Fahrenheit in order to sanitize articles within the washing machine appliance;

determining a volume of heated water required for the wash cycle of the washing machine appliance and whether the set point temperature of the water heater appliance is equal to or greater than the specific temperature, the volume of heated water required for the wash cycle of the washing machine appliance being at the specific temperature;

directing heated water from the water heater appliance into the washing machine appliance if the water heater appliance contains the volume of heated water required for the wash cycle of the washing machine appliance and the set point temperature of the water heater appliance is equal to or greater than the specific temperature at said step of determining;

rechecking the volume of heated water required for the wash cycle of the washing machine appliance after said step of directing;

delaying the wash cycle of the washing machine appliance if the water heater appliance does not contain the volume of heated water required for the wash cycle of the washing machine appliance at said step of rechecking;

calculating a heat loss of water within the washing machine appliance during said step of delaying;

terminating said step of delaying when the water heater appliance contains the volume of heated water required for the wash cycle of the washing machine appliance and the set point temperature of the water heater appliance is equal to or greater than the specific temperature; and supplying heated water from the water heater appliance into the washing machine based on the volume of heated water required for the wash cycle of the washing machine appliance and the calculated heat loss in response to terminating said step of delaying.

2. The method of claim 1, further comprising:

establishing, during said step of delaying, whether the water heater appliance contains the volume of heated water required for the wash cycle of the washing machine appliance; and continuing to delay the wash cycle of the washing machine appliance if the water heater appliance does not contain the volume of heated water required for the wash cycle of the washing machine appliance at said step of establishing, wherein said step of supplying occurs if the water heater appliance contains the volume of heated water required for the wash cycle of the washing machine appliance at said step of establishing.

3. The method of claim 2, further comprising:

ascertaining an elapsed time since said step of delaying; and terminating the delay if the elapsed time exceeds a maximum delay.

4. The method of claim 3, wherein the maximum delay is greater than fifteen minutes and less than three hours.

5. The method of claim 1, further comprising notifying a user of the washing machine appliance that the wash cycle of the washing machine appliance is delayed at said step of delaying.

6. The method of claim 5, wherein said step of notifying comprises sending a text message, electronic mail message or an instant message to the user of the washing machine appliance.

7. The method of claim 1, further comprising increasing the set point temperature of the water heater appliance if the set point temperature of the water heater appliance is not equal to or greater than the specific temperature at said step of determining.

8. The method of claim 1, wherein heated water from the water heater appliance is not directed into the washing machine appliance during said step of delaying.

9. A method for supplying heated water from a water heater appliance to a washing machine appliance, comprising:

operating the water heater appliance such that the water heater appliance heats water to a set point temperature of the water heater appliance;

initiating a wash cycle of the washing machine appliance during said step of operating, the wash cycle of the washing machine appliance requiring heated water having a temperature that is equal to or greater than a specific temperature, the specific temperature being greater than one hundred and thirty degrees Fahrenheit in order to sanitize articles within the washing machine appliance;

determining a volume of heated water required for the wash cycle of the washing machine appliance and whether a set point temperature of the water heater appliance is equal to or greater than the specific temperature, the volume of heated water required for the wash cycle of the washing machine appliance being at the specific temperature;

directing heated water from the water heater appliance into the washing machine appliance if the water heater appliance contains the volume of heated water required for the wash cycle of the washing machine appliance and the set point temperature of the water heater appliance is equal to or greater than the specific temperature at said step of determining;

rechecking the volume of heated water required for the wash cycle of the washing machine appliance after said step of directing;

delaying the wash cycle of the washing machine appliance if the water heater appliance does not contain the volume of heated water required for the wash cycle of the washing machine appliance at said step of rechecking;

calculating a heat loss of water within the washing machine appliance during said step of delaying;

establishing, during said step of delaying, whether the water heater appliance contains a total volume of heated water that includes the volume of heated water required for the wash cycle of the washing machine appliance and an additional volume of heated water based on said step of calculating;

terminating said step of delaying when the water heater appliance contains the total volume of heated water and the set point temperature of the water heater appliance is equal to or greater than the specific temperature;

supplying heated water from the water heater appliance to the washing machine appliance if the water heater appliance contains the total volume of heated water required at said step of establishing; and continuing to delay the wash cycle of the washing machine appliance if the water heater appliance does not contain the total volume of heated water at said step of establishing.

* * * * *